US010253463B2

(12) United States Patent
Kieffer et al.

(10) Patent No.: US 10,253,463 B2
(45) Date of Patent: Apr. 9, 2019

(54) LINE STRIPPER WITH DEPLOYABLE SWEEPER

(71) Applicant: Wagner Spray Tech Corporation, Plymouth, MN (US)

(72) Inventors: Joseph W. Kieffer, Chanhassen, MN (US); Daniel R. Zientara, Lakeville, MN (US); Jonathan L. Schaumann, Champlin, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 15/012,976

(22) Filed: Feb. 2, 2016

(65) Prior Publication Data

US 2016/0222607 A1 Aug. 4, 2016

Related U.S. Application Data

(60) Provisional application No. 62/111,412, filed on Feb. 3, 2015.

(51) Int. Cl.

| | |
|---|---|
| ***E01C 23/16*** | (2006.01) |
| ***E01C 23/22*** | (2006.01) |
| ***E01H 1/05*** | (2006.01) |

(52) U.S. Cl.

CPC ..... *E01C 23/22* (2013.01); *E01H 1/056* (2013.01)

(58) Field of Classification Search

CPC ..... E01C 23/16

See application file for complete search history.

(56) References Cited

U.S. PATENT DOCUMENTS

| | | | | |
|---|---|---|---|---|
| 1,895,045 A | | 1/1933 | Moore | |
| 2,015,695 A | | 10/1935 | Sapp | |
| 2,898,825 A | * | 8/1959 | Walker | E01C 23/185 156/295 |

(Continued)

FOREIGN PATENT DOCUMENTS

| | | |
|---|---|---|
| CN | 101014391 A | 8/2007 |
| GB | 436018 A | 10/1935 |

(Continued)

OTHER PUBLICATIONS

International Search Report and Written Opinion for International Patent Application No. PCT/US2016/016057, dated May 12, 2016, date of filing: Feb. 2, 2016, 15 pages.

(Continued)

*Primary Examiner* — Thomas B Will
*Assistant Examiner* — Katherine J Chu
(74) *Attorney, Agent, or Firm* — Christopher J. Volkmann; Kelly, Holt & Christenson, PLLC

(57) ABSTRACT

The line striper comprises a material deployment system configured to receive a material from a material source and deliver the received material to a deployment mechanism, wherein the deployment mechanism is configured to apply the received material to a surface. The line striper also comprises a mechanical debris removal system configured to, when actuated, move along an application path ahead of the deployment mechanism such that debris is dislodged from the surface, wherein the mechanical debris removal system comprises a contact mechanism configured to facilitate dislodging of the debris from the surface.

17 Claims, 3 Drawing Sheets

(56) References Cited

U.S. PATENT DOCUMENTS 2,964,204 A 12/1960 Wilson
3,162,369 A * 12/1964 Mitchell ..... E01C 23/166 118/305
3,283,675 A * 11/1966 Gifford ..... E01C 19/16 15/50.1
3,590,701 A * 7/1971 Ten Broeck ..... E01C 23/18 156/523
3,700,144 A * 10/1972 Smrt ..... A63C 19/08 222/474
3,864,052 A * 2/1975 Blomberg ..... E01C 23/18 404/94
3,981,596 A 9/1976 Melton
4,256,261 A * 3/1981 Gurney ..... E01C 23/166 239/112
4,267,973 A * 5/1981 Stewart ..... E01C 23/22 118/305
4,373,670 A 2/1983 Kilner
4,557,626 A * 12/1985 McKay ..... E01C 23/06 404/102
4,688,964 A * 8/1987 Cox ..... E01C 19/16 15/98
4,719,659 A * 1/1988 Urakami ..... A47L 11/16 15/49.1
4,765,773 A * 8/1988 Hopkins ..... E01C 23/081 118/305
4,789,265 A * 12/1988 Wilson ..... E01C 11/005 118/108
4,893,751 A * 1/1990 Armstrong ..... E01C 23/22 118/305
4,917,533 A * 4/1990 Wilson ..... E01C 11/005 118/108
5,054,959 A * 10/1991 Wilson ..... E01C 23/166 239/150
5,125,764 A * 6/1992 Veath, Sr. ..... E01C 19/178 404/101
5,213,480 A 5/1993 Yedinak
5,368,232 A 11/1994 Schroeder
5,540,516 A * 7/1996 Nicodemo ..... A63C 19/00 15/79.1
5,742,968 A * 4/1998 Nicholson ..... A01K 1/01 15/83
5,851,086 A * 12/1998 Kurasako ..... B60B 39/00 404/124
5,947,385 A 9/1999 Lanerd
6,062,443 A * 5/2000 Smrt ..... B05B 9/007 222/608
6,102,615 A * 8/2000 Wilson, Sr. ..... E01C 19/16 118/108
6,290,428 B1 * 9/2001 Hall ..... E01C 23/0973 15/103.5
6,478,507 B2 11/2002 Schroeder
6,811,351 B1 11/2004 Schroeder
7,150,413 B1 * 12/2006 Bricko ..... B05B 9/0403 239/147
7,232,277 B2 * 6/2007 Corbitt ..... E04F 21/245 404/112
7,303,155 B2 12/2007 Kesti
7,429,146 B2 * 9/2008 Hall ..... E01C 23/166 222/1
7,654,771 B2 2/2010 Schroeder et al.
7,673,815 B2 * 3/2010 Schroeder ..... E01C 23/22 239/146
7,703,166 B2 4/2010 Raddick
D619,625 S 7/2010 Goodwin
8,021,077 B2 * 9/2011 Annese ..... E01C 19/004 118/305
8,192,108 B1 * 6/2012 Causey ..... E01C 23/163 239/156
D668,686 S 10/2012 Goodwin
8,880,362 B2 * 11/2014 Wilkens ..... B05B 9/06 702/47
9,173,351 B1 * 11/2015 Ng ..... A01G 1/125
2001/0002229 A1 5/2001 Schaeffer et al.
2004/0057795 A1 * 3/2004 Mayfield ..... A63C 19/06 404/84.05
2005/0162119 A1 * 7/2005 Landry ..... A47L 9/2805 318/580
2006/0048800 A1 * 3/2006 Rast ..... A47L 1/02 134/56 R
2009/0208287 A1 * 8/2009 Rouse ..... E01C 23/166 404/75
2010/0072717 A1 * 3/2010 Liska ..... B62B 5/06 280/47.371
2011/0057052 A1 3/2011 Heatley
2011/0139556 A1 6/2011 Kiviahde
2012/0047667 A1 * 3/2012 Arsenault ..... E01H 1/042 15/84
2012/0121332 A1 5/2012 Fredrickson
2012/0203475 A1 * 8/2012 Wilkens ..... E01C 23/20 702/47
2012/0253612 A1 * 10/2012 Byrne ..... E01C 19/4853 701/50
2013/0105078 A1 * 5/2013 Dawson ..... E01C 23/082 156/297
2014/0009308 A1 1/2014 Abuelsaad et al.
2015/0097054 A1 4/2015 Schroeder
2015/0136020 A1 5/2015 Lins
2015/0330039 A1 * 11/2015 Vanneman ..... E01C 23/163 404/94

FOREIGN PATENT DOCUMENTS

GB 759618 A 10/1956
GB 783187 A 9/1957
KR 102018011658 A * 10/2018

OTHER PUBLICATIONS

Extended European Search Report for European Patent Application No. 16747073.1 dated Aug. 27, 2018, 8 pages.
First Office Action for Chinese Patent Application No. 201680005947.9 dated Dec. 14, 2018, 11 pages.

* cited by examiner

LINE STRIPPER WITH DEPLOYABLE SWEEPER

CROSS-REFERENCE TO RELATED APPLICATIONS

The present application is based on and claims the benefit of U.S. Provisional Patent Application Ser. No. 62/111,412 filed Feb. 3, 2015, the content of which is hereby incorporated by reference in its entirety.

BACKGROUND

It is often useful to apply a marking, such as a stripe, to a flat, ground surface, such as a parking lot or roadway. Line stripers are used for painting or otherwise applying lines on pavement or other hard, flat surfaces in parking lots and other locations. Such lines are typically sprayed onto the pavement or other suitable surface using one or more paint spraying guns. Line stripers typically use an internal combustion engine that operably drives a paint pump in order to convey paint or other suitable fluid to the one or more paint spraying guns in order to atomize the paint and direct it to the surface for which lines are desired. In some implementations, the internal combustion engine may also drive a hydraulic fluid pump that provides high pressure hydraulic fluid. This high pressure hydraulic fluid can be used for any number of purposes. In one example, the hydraulic fluid is used to drive a hydraulic paint pump in order to convey the pressurized paint to the one or more spray guns. In this way, hydraulic fluid bears against a hydraulic piston thereby moving the piston. The piston is coupled to a connecting rod that is also coupled to a paint pump piston that is used to pump the paint or other suitable fluid from a container to the one or more paint spray guns at high pressure Outdoor ground surfaces, such as parking lots, are exposed to weather and other elements during their lifetime. For example, they may be periodically exposed to salt or sand during winter months. Removing weather-related and other debris from a surface prior to an application of material to that surface is important to ensure the application lasts.

SUMMARY

A line striper is disclosed. The line striper comprises a material deployment system configured to receive material from a material source and deliver the received material to a deployment mechanism. The deployment mechanism is configured to apply the received material to a surface. The line striper also includes a mechanical debris removal system that, when actuated, moves along an application path ahead of the deployment mechanism such that debris is dislodged from the surface. The mechanical debris removal system includes a contact mechanism that dislodges debris from the surface.

DETAILED DESCRIPTION OF ILLUSTRATIVE EMBODIMENTS

Figure 1:
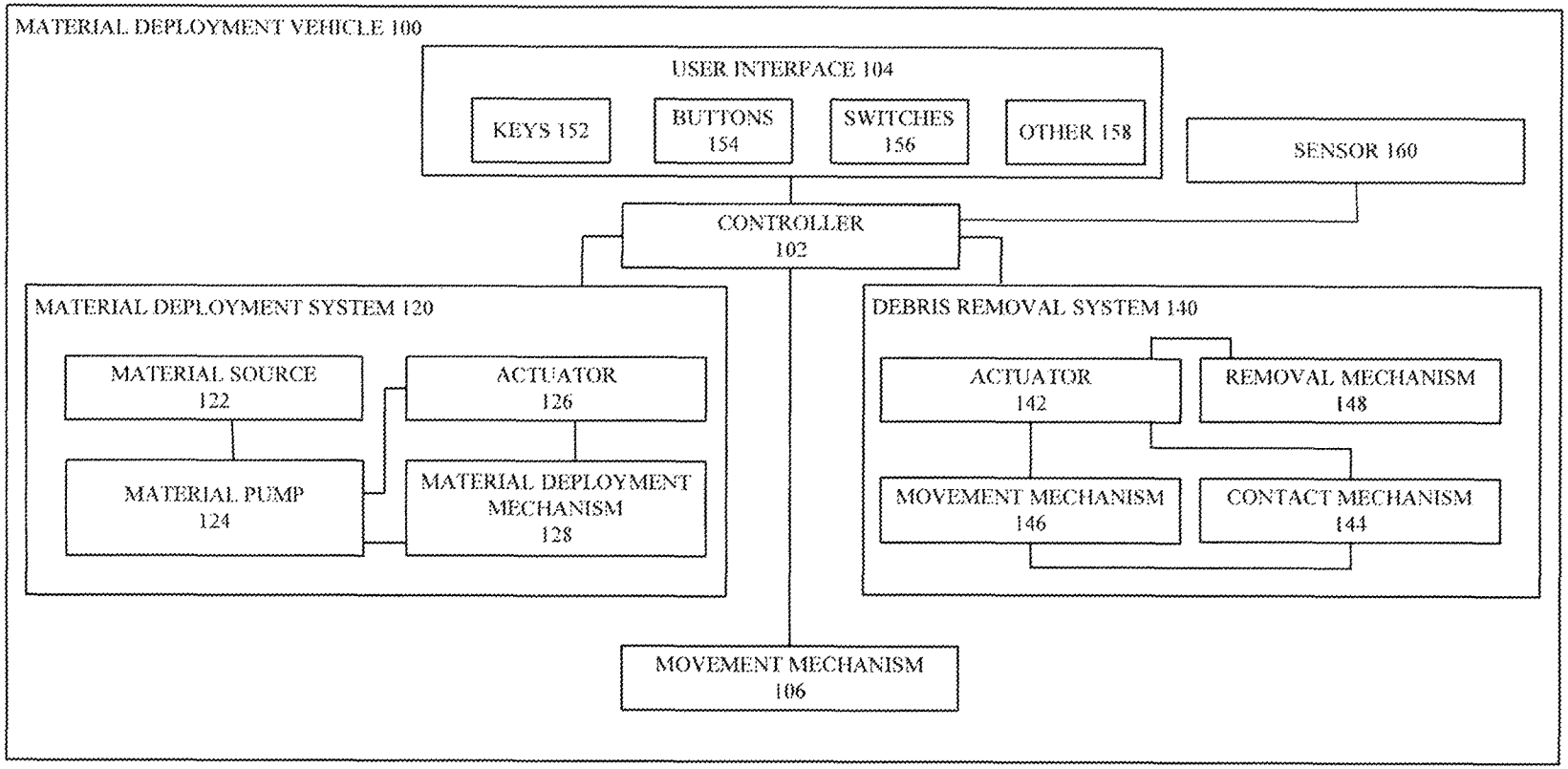
FIG. 1 illustrates a block diagram of one example of a line striper in accordance with an embodiment of the present invention.

Weathering, and other wear conditions, present obstacles to operators of line stripers prior to an application of the stripe to the surface. Line stripers may be configured to dispense a variety of materials including, but not limited to, paint and other colored solutions, resins, acrylics, slurries including some solid and some liquid material, and other appropriate fluids. For the sake of simplicity, but not by limitation, the example of paint is used to describe some embodiments herein. However, other embodiments may be configured to dispense other materials for adherence to a desired surface.

Prior to applying a layer of paint to an asphalt, concrete, or other surface, built-up debris must be removed from the surface in advance such that the paint, when applied, adheres directly to the surface, and not to the accumulated debris. Paint adhering to accumulated debris may flake off or otherwise be prematurely removed. Accumulated debris may comprise, for example, dirt, sand, trash or other debris, dissolved material such as salt applied in advance of, or following, a winter storm.

Paint, or another suitable lining material, is often applied to a hard surface using a vehicle configured to push the line striper. For example, many parking lots, or other appropriate surfaces, in addition to a colored stripe, may also have a reflective coating applied in order to ensure that the stripe is visible at night. Additionally, some material may be applied such that it produces a textured zone on the hard surface, such texture solutions are envisioned in at least some embodiments.

When applying stripes, for example to a parking lot or other hard surface, an assistant will generally walk ahead of the line striper and sweep the surface to remove accumulated dirt and debris from a desired material application zone on the surface. Debris may interfere with the applied material adhering directly to the surface. Such debris may reduce the quality of the applied stripe as debris interferes with the adherence of the material to the surface. In the event that an assistant is not available, the operator of the line striper may be required to first sweep the area prior to striping, and then apply the desired stripes. In both instances, significant additional effort is required before a desired material, such as paint, can be applied to the hard surface. Additionally, such a process introduces significant delay between the debris removal and the paint application.

Some additional problems associated with a separate human operator sweeping the area prior to a line striping operation include, for example, a lack of consistently applied force necessary to remove debris from an intended material application zone on the surface.

In accordance with embodiments described here, a line striper includes, or is associated with, a debris removal system. The debris removal system, in one embodiment, is configured to consistently apply sufficient friction to a surface to remove debris in a material application zone. The application of a consistent, and sufficient, force to the surface may improve debris removal, and may improve the lifetime of a subsequent paint application. Additionally, another problem with using a human operator to sweep the area prior to a line striping operation is that surfaces for line striping operations are often in an outdoor environment, subject to weather and other conditions. Therefore, it is possible that debris may accumulate between a sweeping operation and a subsequent striping application, for example blown into an intended application zone by wind.

FIG. 1 illustrates a block diagram of one example of a line striper in accordance with an embodiment of the present invention. Line striper 100, in one embodiment, comprises a controller 102, a user interface 104, a movement mechanism 106, a material deployment system 120 and a debris removal system 140. In one embodiment, line striper 100 comprises a plurality of controllers 102, for example a controller for material deployment system 120 and a controller for debris removal system 140. In one embodiment, controller 102 is actuated by an operator's command, for example, received through user interface 104. User interface 104 may comprise, in one embodiment, a user input mechanism, for example keys and/or buttons and/or switches and/or another appropriate user input mechanism. In one embodiment, user interface 104 also comprises a display, or other appropriate output mechanism, configured to provide status information to a user, for example an indication that debris removal system 140 has been actuated.

Line striper 100 also includes a material deployment system 120 that receives material for application from a material source, such as material source 122 illustrated in FIG. 1. Material source 122 may be configured to store, in one embodiment, any of: paint, resin, acrylic, coating, or another appropriate application material. In another embodiment, material source 122 may comprise a source of material carried on a vehicle separate from material deployment system 120, for example an accompanying trailer. In one embodiment, material source 122 is pressurized.

Material deployment system 120, when actuated by actuator 126, provides material from source 122 to a material deployment mechanism 128. In the illustrated example, the mechanism for transferring material from material source 122 to material deployment mechanism 126 includes one or more pumps 124. Pump 124 is configured to pressurize a fluid material before providing it to material deployment mechanism 128 for a given spraying application. In one embodiment, material is provided to material deployment mechanism 128 at a desired application pressure. Material deployment mechanism 128 may include one or more spray guns, or spray nozzles, that provide the material in a fan-shaped pattern, or other appropriate disbursement pattern. In at least one embodiment, the dispersed material is partially aerosolized, such that it is dispensed by material deployment mechanism 128 as a series of tiny atomized droplets. Pump 124 may be a piston pump, or any other suitable device.

Controller 102 may be coupled to one or more movement mechanisms 106. In one embodiment, movement mechanism 106 comprises one or more wheels configured to allow for forward and backward movement of line striper 100, in one embodiment. Movement mechanism(s) 106 may be configured to allow for the line striper 100 to turn, for example to the right or to the left such that non-linear material disbursement patterns can be achieved.

In one embodiment, controller 102 is configured to control operation of a propulsion system, for example an internal combustion engine driving operation of line striper 100. In another embodiment, controller 102 comprises control over one or more subsystems of line striper 100, for example movement mechanism 106, material deployment system 120, debris removal system 140 (discussed below), or another subsystem.

Line striper 100 may include a wheeled cart, configured to move forward with the application of at least some force by an operator. In another embodiment, when actuated, line striper 100 is self-propelled. Line striper 100 may include a seat such that an operator can actuate operation, and movement, of line striper 100 in a seated position.

Line striper 100 comprises a debris removal system 140 configured to contact a surface and remove debris located in a material application zone ahead of line striper 100. In one embodiment, debris removal system 140 operates, at least in part, by applying friction forces to the surface in order to dislodge debris from the application zone. In another embodiment, debris removal system 140 operates by applying a vacuum force sufficient to dislodge debris. In a further embodiment, debris removal system 140 operates by blowing air, or another gaseous material, sufficient to dislodge debris. In one embodiment, a combination of applied forces operate in concert to dislodge and remove debris.

Debris removal system 140 is configured to remove debris just ahead of material deployment system 120, for example, debris in a spray path of material deployment system 120. In one embodiment, debris removal system 140 is physically attached to line striper 100. In another embodiment, debris removal system 140 is coupled to material deployment system 120 such that it operates in the path of, but is separate from, material deployment system 120. Debris removal system 140 and material deployment system 120 may be coupled such that operation of one system triggers actuation of the other system. In another embodiment, debris removal system 140 and material deployment system 120 may operate independently, requiring separate actuation by an operator of line striper 100.

Debris removal system 140 comprises actuator 142 which is configured, when actuated, to urge contact mechanism 140 from a storage configuration to a deployed configuration. In the deployed configuration, contact mechanism 140 contacts the surface, where the contact is sufficient to dislodge debris from an application zone on the surface in anticipation of a material application. Actuation may comprise, in one embodiment, physical movement of contact mechanism 140, for example rotational movement or vertical movement.

Debris removal system 140 also includes movement mechanism 146 configured to increase friction between contact mechanism 144 and the surface, for example by causing movement of contact mechanism 144 against the ground. Movement mechanism 146 may rotate contact mechanism 144, in one embodiment. In another embodiment, movement mechanism 146 is configured to cause contact mechanism 144 to rapidly move back and forth, or vibrate, when in contact with the surface. In another embodiment, movement mechanism 146 moves contact mechanism 144 back and forth a plurality of times over a surface in order to dislodge debris through applied friction.

Debris removal system 140 comprises a removal mechanism 148. Removal mechanism 148 may include an air compressor configured to deliver compressed air sufficient to force collected debris out of a material application zone. In another embodiment, removal mechanism 148 may include a blower configured to blow air toward the collected debris such that the collected debris is scattered out of the application zone ahead of material deployment mechanism 128. In one embodiment, removal mechanism 148 comprises at least a partial vacuum applied, such that dislodged debris is either collected within a debris receptacle, or removed from the striping application area, for example by a discharge or other appropriate removal mechanism.

Debris removal system 140 is actuated by actuator 142 into, and out of, a deployed position. In at least one embodiment, it may be desired for debris removal system 140 to be removed out of a deployed position ahead of a line striper 100, for example if line striper 100 is approaching a curb, debris removal system 140 may need to be moved out of the way to avoid a collision with the curb, and potential damage to debris removal system 140. In one embodiment, actuator 142 rotates debris removal system 140 between a deployed and a storage position. The storage position, for example, comprises debris removal system 140 in a non-contact position with the surface. In one embodiment, the storage position comprises debris removal system 140 in a different physical orientation with respect to the material deployment system 120. In one embodiment, rotation between a deployed position and a storage position comprises a rotation of at least 90°.

Actuator 142 is configured to actuate debris removal system 140 into a locked position, for example such that debris removal system 140 can be locked into a deployed position, a storage position, and/or a position intermediate deployed and storage positions. A locked deployed position can be used to ensure that sufficient force is applied to contact mechanism 144 to dislodge anticipated accumulated debris. Actuator 142 is coupled to controller 102, such that actuation is triggered based on a received command, for example, input through user interface 104. In one embodiment, actuator 142 operates with at least partial autonomy, such that it is configured to automatically move contact mechanism 144 between deployed and storage positions, for example, based on sensed debris or an anticipated collision. Partial autonomy may be governed, at least in part, by received indications from a sensor located near the front of line striper 100. The sensor may be configured to sense debris or other objects directly in front of an operational area of debris removal system 140.

Debris contact mechanism 144 includes, in one embodiment, a circular brush with a plurality of bristles. The brush 144 rotates such that bristles, or other dislodging mechanism, engage the hard surface. In one embodiment, brush 144 rotates in a clockwise direction. In another embodiment, brush 144 operates in a counterclockwise direction. Brush 144 may include metal bristles, or any other suitably abrasive structures. The bristles, or other suitable structures, are sufficiently rigid to provide adequate abrasion. In one embodiment, debris removal system 140 comprises a brush 144 composed of a plurality of bristles configured to maintain substantially constant contact with the hard surface.

Figure 2:
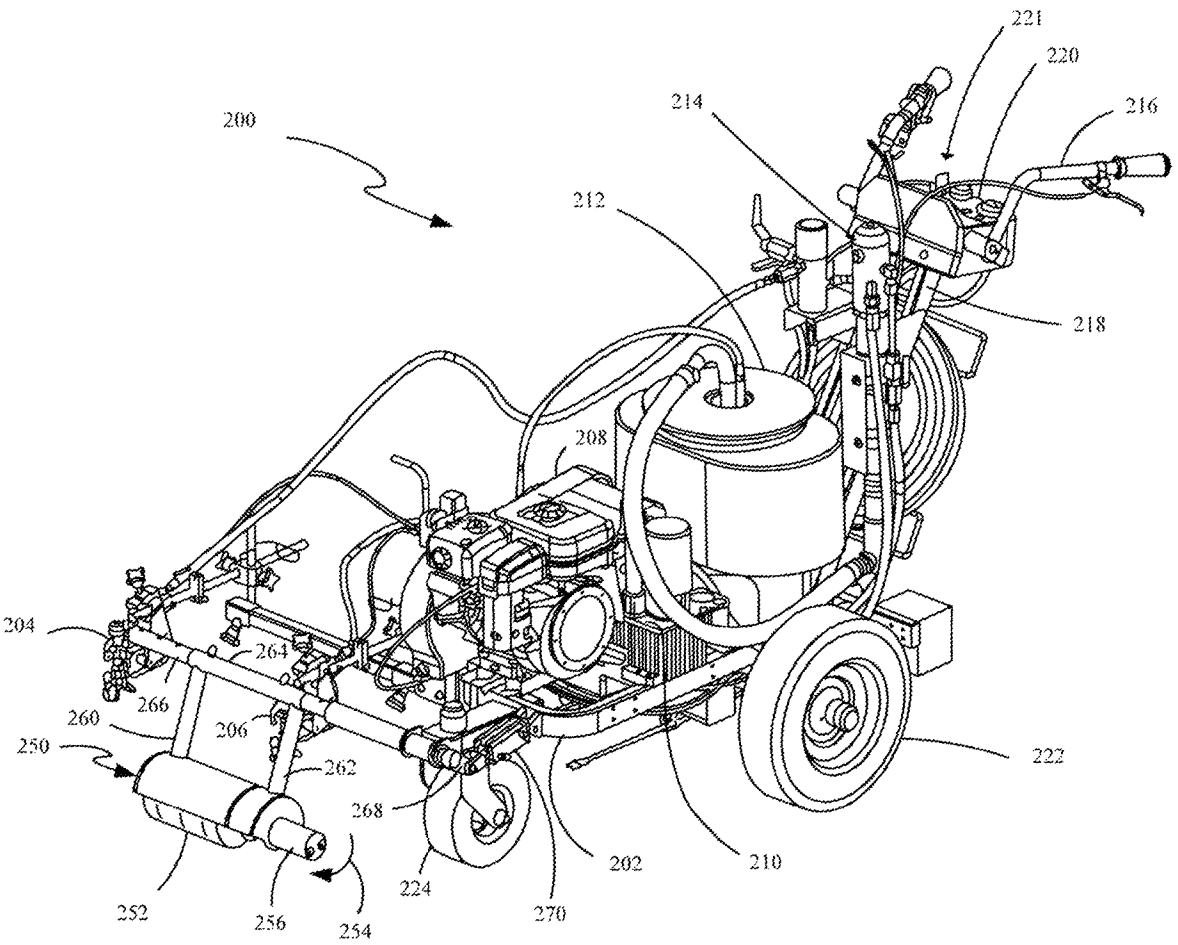
FIG. 2 illustrates one example line striper system in accordance with one embodiment of the present invention.

FIG. 2 illustrates an example line striper in accordance with one embodiment of the present invention. In one embodiment, line striper 200 comprises one or more deployable rotating brushes physically located proximate spray guns such that the brushes proceed first along an anticipated material path. This configuration may allow for the surface to be swept immediately prior to the application of the paint, or other exemplary material, such that high quality stripes can be achieved and paint adhesion to the surface improved when compared to conventional sweeping operations.

Line striper 200 comprises an elongate frame 202 configured to support one or more spraying guns, for example guns 204 and 206 illustrated in FIG. 2. Line striper 200, in one embodiment, includes an internal combustion engine 208, an actuator 210, a material reservoir 212, and pump assembly 214. In one embodiment, actuator 210 comprises a hydraulic actuator. In another embodiment, actuator 210 comprises an electric actuator. A set of handlebars 216, in one embodiment, is operably coupled to elongate frame 202, by one or more brackets 218, and is configured to facilitate operator control of line striper 200. Additionally, a control panel 220 is also provided, in one embodiment, to facilitate operator control of line striper 200.

Frame 202 is supported, in one embodiment, by wheels 222. In one embodiment, frame 202 is also supported by an omnidirectional caster wheel 224. In one embodiment, wheels 222 may be driven by power generated from internal combustion engine 208 directly, in one embodiment. In another embodiment, wheels 222 are driven by power generated from internal combustion engine 208 indirectly, via actuator 210. Additionally, in one embodiment, line striper 200 comprises a seat for an operator (not shown) configured to allow the operator to sit in or on line striper 200 while a propulsion mechanism, or separate propulsion vehicle, urges line striper 200 along a desired path.

Line striper 200 includes a deployable sweeper system 250. In one embodiment, sweeper system 250 comprises a circular brush 252 configured to rotate in a direction, for example a direction indicated by arrow 254. Causing brush 252 to rotate in direction 254, in one embodiment, forces dirt and other debris to be dislodged just ahead of sweeper system 250. Brush 252 may be urged to rotate in accordance with any suitable technique. In one embodiment, forward movement of line striper 200 causes rotation of brush 252. In one embodiment, rotation of brush 252 is driven by a motor, for example an electric motor, a hydraulic motor, or another appropriate driving mechanism. In one embodiment, for example that shown in FIG. 2, hydraulic motor 256 is coupled to actuator 210. Additionally, depending on the parameters of brush 252 (for example abrasiveness, stiffness, etc.), the speed of rotation and the downward pressure exerted by line striper 200 allows deployable sweeper system 250 to strip previously applied paint or other material from the surface prior to the application of new paint lines.

Deployable sweeper system 250, in one embodiment, is supported by one or more arms, for example arms 260 and 262 illustrated in FIG. 2, which may be coupled to a sleeve 264. Sleeve 264, in one embodiment, is rotationally fixed to shaft 266, such that rotation of shaft 266 will cause sweeper system 250 to rotate about shaft 266, and move between storage and deployment positions, depending on the rotational direction of shaft 256. In one embodiment, a bracket 268 is coupled to one end of shaft 266 such that a hydraulic actuator 270 causes rotation of shaft 266, and lifts or lowers brush 252 as desired by an operator. In one embodiment, this functionality is important because as line striper 200 approaches a curb, or other object on a parking lot, sweeper system 250 should be raised in order to avoid collision with the curb or object and resulting damage to sweeper system 250.

While some embodiments of the present invention generally comprise a user actuable control that allows the user to deploy and store sweeper system 250, other embodiments comprise one or more proximity sensors to detect the approach of an object. The use of a sensor-based detection mechanism may allow for the line striper to receive a conveyed indication of an approaching object, such that a controller, or other suitable device, actuates hydraulic actuator 270 in order to move sweeper system 250 into and out of a deployed position. In one embodiment, actuation comprises a solenoid automatically engaging hydraulic actuator 270.

A proximity sensor may also be used to determine that a previously detected object is no longer proximate striper 200, and automatically reengages sweeper system 250 into contact with the material application zone. However, in another embodiment, a sensor may be configured to, upon detection of an approaching object, trigger actuation of sweeper system 250 from a deployment position to a storage position. However, in one embodiment, at least some manual control may be required in order to re-lower sweeper system 250. Manual control may comprise, in one embodiment, an operator indication, for example through a user interface, to redeploy sweeper system 250 into contact with the ground.

Line striper 200, in the embodiment illustrated in FIG. 2, comprises a single sweeper system 250, with a single brush 252, located ahead of spray gun 206. However, it is to be understood that this is for the sake of clarity only. In one embodiment, line striper 200 comprises a sweeper system 250 with a plurality of brushes 252. In another embodiment, a series of sweeper systems 250, each comprising one or more brushes 252, are located ahead of spray gun 206 in order to ensure sufficient debris removal from a material application zone.

The use of a plurality of sweeper systems 250, with a plurality of brushes 252, may be helpful in the event that the debris to be removed is particularly fine. In an embodiment where multiple sweeper systems 250, or multiple brushes 252 within a single system 250, are deployable, such that each brush 252 may be actuated between deployment and storage positions in unison by coupling each to rod 266. In another embodiment, a plurality of brushes 252 may be actuated between deployment and storage positions independently, such that each brush 252 is paired with an actuator 270 and independently coupled to a rod 266. In one embodiment, a single sweeper system 250 comprises multiple brushes 252, with each brush 252 coupled to an associated proximity sensor, such that each brush 252 may be automatically actuated between deployment and storage positions in order to prevent a collision with a detected object.

Actuator 210 may be configured to actuate sweeper system 250 on a sequence valve such that, in response to the operator actuating an electric switch, for example positioned on control panel 120, a solenoid valve is caused to switch positions. In another embodiment, instead of an electric switch, a hydraulic or other actuator system is deployed. Once actuated, the solenoid valve causes material flow to actuate actuator 270, such that when actuator 270 dead heads or otherwise reaches the end of its throw, the sequence valve switches position and turns on the hydraulic motor, which drives actuation of sweeper system 250. When the operator actuates the electric switch in the opposite direction, in one embodiment, the reverse operation sequence occurs. First, the motor stops turning, then actuation of actuator 270 causes material flow to the circuit to stop. In this way, at least some embodiments of the present invention are configured to cease rotation of brush 252 while sweeper system 250 is in a storage position. This may increase safety to sweeper system 250 and line striper 200, and may also reduce the amount of dust other debris that may be thrown by rotating brush 252.

Figure 3:
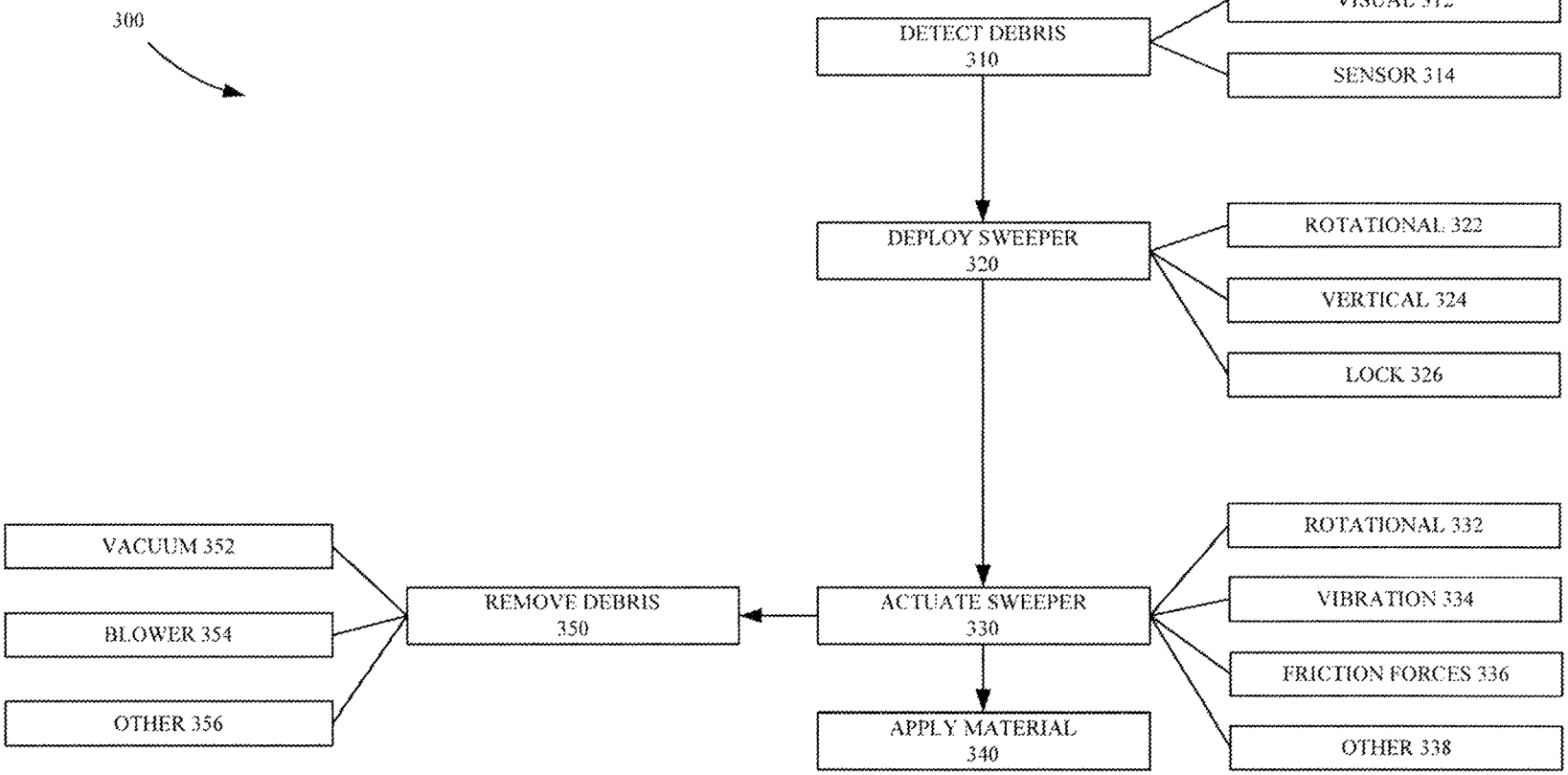
FIG. 3 illustrates an example method of deploying a sweeper system in accordance with one embodiment of the present invention.

FIG. 3 illustrates an example method of deploying a sweeper system in accordance with one embodiment of the present invention. Method 300 may be useful, in one embodiment, for deploying a sweeper system that is an integral part of a line striper.

In block 310, debris is detected. In one embodiment, debris is detected ahead of a material dispensing system on a line striper. Debris may be visually detected by an operator, as indicated in block 312, in one embodiment. Upon detecting debris, the sweeper may be configured to automatically trigger deployment of a debris removal system. In at least one embodiment, some manual control is required to actuate a debris removal system, for example, by an operator flipping a switch, pressing a button, or otherwise entering a command on a user interface or directly actuating the debris removal system.

In block 320, a sweeper system is deployed. Deploying a sweeper system, in one embodiment, comprises moving the sweeper system from a storage position to a deployed position. In another embodiment, deploying the sweeper system comprises actuating movement of the sweeper system, which is configured to maintain a constant position with respect to a frame of the line striper. Actuating a sweeper system between the storage position and the deployed position comprises rotational movement, as indicated in block 322, and/or vertical movement of the sweeper system between the storage position and the deployed position, as indicated in block 324. In one embodiment, a deployed position may comprise the sweeper system in a locked position, as indicated in block 326, such that rotational, and/or vertical movement of the system is reduced, and a substantially constant force can be applied to urge a contact mechanism of the sweeper system into contact with the surface.

In block 330, the sweeper system is actuated. This may include maneuvering a contact mechanism into position with a surface such that debris is dislodged from the surface. In one embodiment, actuating comprises allowing passive movement of the contact mechanism across the surface, as indicated in block 338. In another embodiment, actuation comprises mechanically driving the contact mechanism over an intended material application zone on the surface. Mechanically driving, in one embodiment, comprises causing rotation of the contact mechanism, as indicated in block 332. In one embodiment, the contact mechanism comprises a circular brush configured to rotationally contact the surface. Mechanical driving, in another embodiment, comprises causing the contact mechanism to vibrate against the surface, as indicated in block 334. Mechanical driving, in another embodiment, comprises urging the contact mechanism into contact with the surface such that friction forces dislodged accumulated debris, as indicated in block 336.

In block 340, material is applied to an application zone on a surface, for example by a line striper or other material dispensing vehicle. In one embodiment, the applied material comprises paint. In one embodiment, material is deployed shortly after a sweeper removes debris from a desired application surface, such that a substantially debris-free surface receives the applied material.

In block 350, accumulated debris is removed from a material application zone. The debris can be removed by an applied vacuum configured to pull dislodged debris from the application zone, as indicated in block 352. However, the debris can also be removed by an air source, for example a compressor or a blower configured to push dislodged debris from the application zone, as indicated in block 354.

Although the present invention has been described with reference to preferred embodiments, workers skilled in the art will recognize that changes may be made in form and detail without departing from the spirit and scope of the invention.

What is claimed is:

1. A line striper movable along a surface and configured to apply a stream of material to the surface, the line striper comprising:

a material deployment system configured to receive material from a material source and deliver the received material to a material deployment mechanism, wherein the material deployment mechanism is configured to apply, in a stream, the received material to a first portion of the surface in an application path;

a mechanical debris removal system comprising a surface contact mechanism that is movable between a first position and a second position independent of both: the material deployment mechanism applying the material to the surface, and movement of the line striper along the surface, wherein, when in the first position, the surface contact mechanism is configured to contact a second portion of the surface in the application path ahead of the material deployment mechanism such that the surface contact mechanism dislodges debris from the second portion of the surface while the material deployment mechanism applies the material to the first portion of the surface; and a controller configured to:

based on a control input, actuate the surface contact mechanism from the first position to the second position, away from the surface, while the material deployment mechanism applies the material to the first portion of the surface.

2. The line striper of claim 1, wherein the mechanical debris removal system comprises an actuator coupled to, and actuated by, the controller to move the surface contact mechanism between the first and second positions.

3. The line striper of claim 2, and further comprising:

a user interface comprising a user input mechanism, wherein the control input comprises a user input through the user input mechanism.

4. The line striper of claim 3, wherein the user interface comprises an output mechanism configured to render, to a user of the line striper, an indication of deployment of the mechanical debris removal system.

5. The line striper of claim 2, wherein the surface contact mechanism is rotatable about a rotational axis, to move the surface contact mechanism between the first and second positions.

6. The line striper of claim 2 and further comprising:

a movement mechanism configured to facilitate movement of the line striper along a surface and wherein the surface contact mechanism is rotationally driven by at least one of: an electric motor or a hydraulic motor.

7. The line striper of claim 2 wherein the actuator comprises a hydraulic actuator.

8. The line striper of claim 1, and further comprising:

a sensor configured to:

detect an object in the application path ahead of the surface contact mechanism; and generate an indication of the detected object.

9. The line striper of claim 8, wherein the control input is based on the indication.

10. The line striper of claim 9, wherein the controller is configured to operate with at least partial autonomy.

11. The line striper of claim 10, wherein the controller is configured to:

in response to the indication from the sensor, autonomously send a control signal to actuate the surface contact mechanism.

12. The line striper of claim 11, wherein the indication is indicative of a proximity of the object to the line striper.

13. The line striper of claim 5, wherein the surface contact mechanism is rotatable about the rotational axis by an angle of at least ninety degrees.

14. The line striper of claim 1, wherein the mechanical debris removal system is configured to lock the surface contact mechanism in the first position.

15. The line striper of claim 3, wherein the user interface comprises a control panel.

16. The line striper of claim 15, wherein the user input mechanism is positioned on the control panel, and the controller is configured to control an actuator to actuate the surface contact mechanism in response to actuation of the user input mechanism.

17. The line striper of claim 16, wherein the user input mechanism comprises at least one of: a key, a button, or a switch.

* * * * *